US005915551A

United States Patent [19]

Vavro

[11] Patent Number: 5,915,551

[45] Date of Patent: Jun. 29, 1999

[54] GOLF BAG WITH INTEGRATED BEVERAGE COOLER

[76] Inventor: David J. Vavro, 14004 Golden Arrow Ct., Shelby Township, Macomb County, Mich. 48315

[21] Appl. No.: 09/121,365

[22] Filed: Jul. 23, 1998

[51] Int. Cl.[6] ..... A63B 55/00; A63B 57/00

[52] U.S. Cl. ..... 206/315.5; 206/315.3

[58] Field of Search ..... 62/457.5; 206/315.3, 206/315.5, 315.6

[56] References Cited

U.S. PATENT DOCUMENTS

| | | | |
|---|---|---|---|
| 2,521,573 | 9/1950 | Filler et al. | 206/315.3 |
| 4,319,616 | 3/1982 | Light | 206/315.6 X |
| 5,062,528 | 11/1991 | Whitaker, Jr. | 206/315.5 X |
| 5,072,867 | 12/1991 | Zingale | 206/315.3 X |
| 5,176,253 | 1/1993 | Perrin et al. | 206/315.3 X |
| 5,247,798 | 9/1993 | Collard, Jr. | 62/457.5 X |
| 5,277,328 | 1/1994 | Tocco | 206/315.3 X |
| 5,582,343 | 12/1996 | Dalvey | 62/457.5 X |
| 5,640,855 | 6/1997 | Crescenzo et al. | 206/315.3 X |
| 5,699,906 | 12/1997 | Lombardo et al. | 206/315.5 X |
| 5,722,253 | 3/1998 | Todd | 206/315.5 X |

FOREIGN PATENT DOCUMENTS

| | | | |
|---|---|---|---|
| 563215 | 9/1958 | Canada | 206/315.6 |
| 2234912 | 2/1991 | United Kingdom | 206/315.3 |

*Primary Examiner*—Sue A. Weaver
*Attorney, Agent, or Firm*—John R. Benefiel

[57] ABSTRACT

A golf bag is equipped with an integrated beverage cooler located in the bottom section of the bag beneath the main storage cavity. A chute portion extends upwardly to the side of the bag, with a zippered opening in the side of the bag, beneath the ball storage pocket, allowing access into the cooler for loading and removal of beverage cans and ice. A drain filter allows drainage of water from the cooler through the bottom of the bag.

7 Claims, 1 Drawing Sheet

GOLF BAG WITH INTEGRATED BEVERAGE COOLER

BACKGROUND OF THE INVENTION

This invention concerns portable beverage coolers of the type adapted to keep cans of soft drinks and beer cool for extended periods of time, and in particular for use by golfers as they play a round of golf.

Since golf is played during the warmer months and often involves walking long distances, it would be desirable that the golfer have cold beverages available with him or her while out on the course.

There thus have been devised various cooler receptacle designs to be carried in or on the golfer's bag, or in some cases integrated in the bag itself.

The add-on receptacles are bulky, taking up space normally available for golf clubs, are conspicuous, or do not always provide convenient access.

See, as examples, the golf bag coolers shown in U. S. Pat. Nos. 5,301,519; 4,459,827; and 4,924,682.

It is the object of the present invention to provide an integrated golf bag cooler which is compact and inconspicuous, still allowing for ample space for the usual golf equipment, while at the same time provide adequate space for beverage containers and easy access.

SUMMARY OF THE INVENTION

The above object, as well as others, which will become apparent upon a reading of the following specification and claims, are achieved by a golf bag having installed a cooler configured to be fit within the bottom of the golf bag beneath the main storage cavity of the bag. An outwardly inclined entryway or chute portion extends beneath a ball storage side pocket conventionally provided. A zippered opening through the bag located beneath the storage pocket allows access to the cooler interior through the chute portion.

The cooler is preferably constructed of rigid foam plastic and may have durable inner and outer layers to be resistant to wear and damage.

A hinged lid panel may be installed over the open top of the entryway portion, or a flexible insulating tube may be attached to extend to the zippered opening.

The bag height may be higher to compensate for the presence of the cooler and allow the clubs to be held in the usual manner.

The cooler while providing ample space is inconspicuous and does not present any hindrance to access to the golf equipment stored in the bag, but does allow convenient access to the stored beverage cans.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
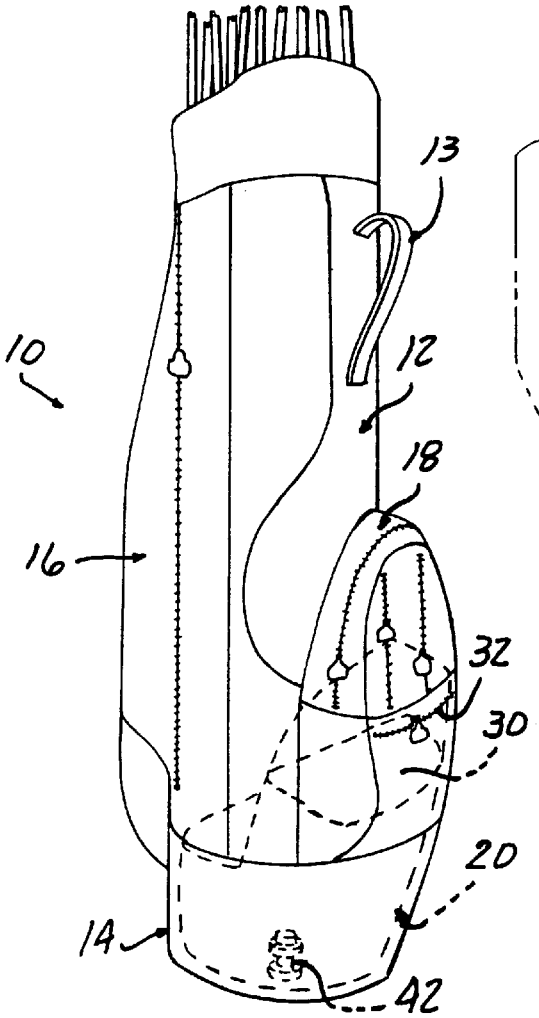
FIG. 1 is a perspective view of a cooler equipped golf bag according to the present invention.

Referring to FIG. 1, a golf bag 10 is shown, which can be largely of conventional construction, having generally cylindrical upper section 12 with a handle 13, the bag adapted to be stood upright on relatively stiff bottom section 14, an elongated main storage cavity defined in the upper section for stowage of golf clubs or elongated accessory articles.

A zippered pocket 16 extends up and down at the rear of the upper section 12, for stowage of an umbrella, towels, rain gear, etc. A front located shorter zippered pocket 18 is provided for balls, tees, and smaller items in the usual way.

According to the concept of the present invention, a cooler 20 is installed within the bottom section 14. The cooler 20 has a bottom portion 22 which is; generally cylindrically shaped in correspondence with the shape of the bottom section of the golf bag. A flat cover 24 extends partially across the top of the bottom portion, with the bottom wall 26 of the golf bag itself overlying the cover 24, and supporting the ends of the golf clubs and other items stowed in the main storage section of the bag.

An outwardly angled chute portion 28 extends upwardly from one side of the top of the bottom portion and into a bag cavity 30 defined below the front pocket 18. An access zipper 32 when opened allows reaching into the interior 36 of the chute portion 28 and bottom portion to reach beverage cans 34 stored therein.

Figure 4:
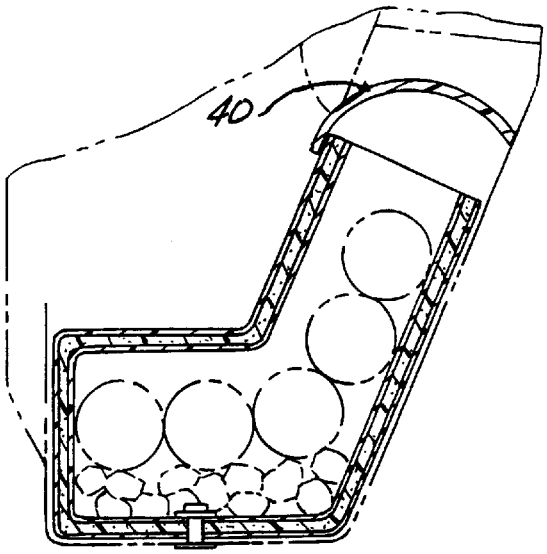
FIG. 4 is a cross sectional view of a modified form of the cooler with adjacent portions of the golf bag shown in phantom.
Figure 2:
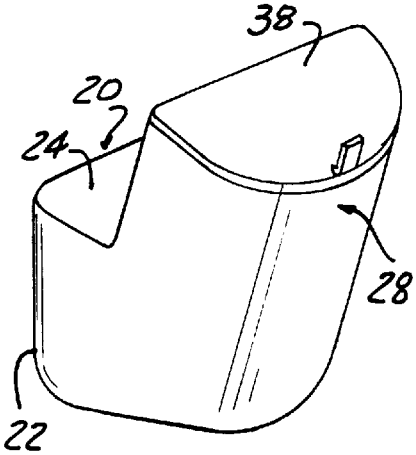
FIG. 2 is a separated perspective view of the cooler installed in the golf bag shown in FIG. 1.
Figure 3:
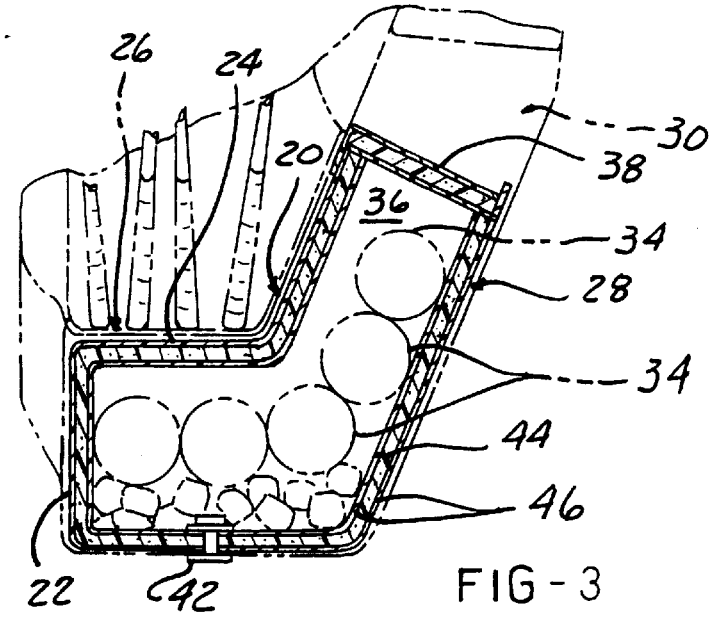
FIG. 3 is a cross sectional view of the cooler with beverage containers stored therein, with adjacent portions of the golf bag in phantom.

A cooler cover panel 38 can be hinged to the top of the chute portion 28, or alternatively, a thick flexible flap 40 (FIG. 4) can be provided for easier access.

A drain plug 42 is provided allowing draining of water accumulating from the melting of ice placed in the interior of the cooler cavity 36.

The cooler 20 is preferably constructed of a core 44 of insulating foam plastic, with tough outer layers 46 of a durable plastic so as to withstand rough handling of the bag itself, as well as the jolts typically occurring as a cart is pulled along rougher terrain.

The length of the upper section 12 may be somewhat longer to compensate for the presence of the cooler 20.

The cooler 20 is thus unobtrusive and out of the way, yet provides ample space for a number of beverage cans and easy access for loading and retrieval of the cobs. The golf bag has a conventional trim appearance in contrast to the awkward appearance of a bag having external attachment type coolers described above.

I claim:

1. A golf bag comprising:

a generally cylindrical open-topped upper section closed off at the lower end by a bottom section, the upper section defining a main storage cavity for receiving golf clubs and similar elongated items;

an insulated cooler mounted within said bottom section underlying said main storage cavity, said cooler having an internal cavity for receiving beverage cans and a top wall located beneath said main storage cavity, an opening in said top wall, and a chute portion extending upwardly and outwardly from said top wall opening allowing loading of said cans into said internal cavity and retrieval therefrom;

a selectively openable side pocket on said golf bag, said chute portion extending into said side pocket and having an opening at a top portion thereof within said side pocket providing access into said cooler top opening, allowing loading and removal of beverage cans from said cooler through said side pocket.

2. The golf bag according to claim 1 wherein said cooler top wall is rigid to support golf clubs in said main cavity.

3. The golf bag according to claim 2 further including a hinged lid overlying said chute top opening.

4. The golf bag according to claim 2 further including a flap overlying said chute top opening.

5. The golf bag according to claim 1 wherein said golf bag side pocket provides for storage of small items and has a zippered opening.

6. The golf bag according to claim 1 further including a drain fitting extending through a bottom wall of said cooler and of said golf bag bottom section allowing drainage of water from melted ice in said cooler cavity.

7. The golf bag according to claim 1 wherein said cooler is constructed of rigid walls having a foamed plastic core and durable plastic covering layers on each side of said core.

* * * * *

UNITED STATES PATENT AND TRADEMARK OFFICE

CERTIFICATE OF CORRECTION

PATENT NO. : 5,915,551

DATED : June 29, 1999

INVENTOR(S) : David J. Vavro

It is certified that error appears in the above-indentified patent and that said Letters Patent is hereby corrected as shown below:

Column 2, line 55, delete "cobs" insert therefor --cans--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*